US006601703B1

(12) United States Patent
Jones et al.

(10) Patent No.: US 6,601,703 B1
(45) Date of Patent: Aug. 5, 2003

(54) THREE DIMENSIONAL CONTAINER REPRESENTATION

(75) Inventors: John Scott Jones, Eggertsville, NY (US); Elmer (Chuck) H. Goss, East Amherst, NY (US)

(73) Assignee: FWJ Plastic Packaging, Inc., Getzville, NY (US)

( * ) Notice: Subject to any disclaimer, the term of this patent is extended or adjusted under 35 U.S.C. 154(b) by 12 days.

(21) Appl. No.: 10/041,828

(22) Filed: Jan. 7, 2002

Related U.S. Application Data

(63) Continuation-in-part of application No. 09/633,736, filed on Aug. 7, 2000, now abandoned.

(51) Int. Cl.[7] ..... B65D 73/00

(52) U.S. Cl. ..... 206/457; 206/459.5; 206/497

(58) Field of Search ..... 206/457, 459.5, 206/497; 40/310; 428/13; 446/391, 73

(56) References Cited

U.S. PATENT DOCUMENTS

| | | | | |
|---|---|---|---|---|
| 151,802 A | | 6/1874 | Spencer | |
| 3,604,584 A | * | 9/1971 | Shank, Jr. | 215/12.2 |
| D250,320 S | | 11/1978 | Frohling | |
| D259,247 S | | 5/1981 | Sztuden | |
| D321,825 S | | 11/1991 | Schlesselman | |
| 5,419,447 A | | 5/1995 | Lim | |

* cited by examiner

*Primary Examiner*—David T. Fidei
(74) *Attorney, Agent, or Firm*—Harpman & Harpman

(57) ABSTRACT

A container configuration having two and three-dimensional characteristics on a single multiple dimensional surface that define a portion of the container. The combination of certain three-dimensional surface areas with two-dimensional graphic indicia overlay wherein indicia impart enhanced dimensional characteristics to actual multi-dimensional surfaces not having the physical characteristics imparted by the surface themselves.

12 Claims, 5 Drawing Sheets

THREE DIMENSIONAL CONTAINER REPRESENTATION

This is a continuation in part application of Ser. No. 09/633,736, filed Aug. 7, 2000 now abandoned.

BACKGROUND OF THE INVENTION

1. Technical Field

This invention relates to containers having the appearance of realistic or whimsical representations by molding the container shape to impart that representation.

2. Description of Prior Art

Prior art devices of this type have generally relied on molding the surface of the container to mimic a naturalistic shape or fanciful image to be depicted. Typically a container is formed in the overall shape of the entity such as an animal or a human head, see for example U.S. Pat. Nos. 151,802 and 5,419,447.

Other examples of prior art entail a relief representation of figures such as in U.S. Pat. Nos. D259,247, D321,825 and D250,320. Some prior art attempts to combine general body shape on a container with graphic representation, see for example U.S. Pat. No. D355,592 in which a rabbit representation is illustrated on a molded shape presumably a confectionery packaging of this type.

A publication "Packaging Digest" 1989 ISSN: 0030-9117, pages 26, 76, 71, 73 and 74, search summary printout refers to pressure sensitive label equipment on a 3-D figure (the raisin people) with sunglasses, hands and shoes.

SUMMARY OF THE INVENTION

A fanciful container configuration and method in which three-dimensional characteristics are represented by combining a two and three-dimensional process that imparts characteristics of both to a single distinguishable bottle configuration. Certain three-dimensional features are emphasized and enhanced by conforming a two-dimensional surface overlay with indicia thereon that registers on portions of the corresponding and underlying dimensional features imparting enhanced physical properties of the container itself. Remaining indicia portions extending beyond the dimensional features to impart extended transitional feature embellishments to enhance the multiple dimensional qualities of the container beyond that of simple registration overlays that conform to the original 3-D features only.

DESCRIPTION OF THE PREFERRED EMBODIMENT

Figure 1:
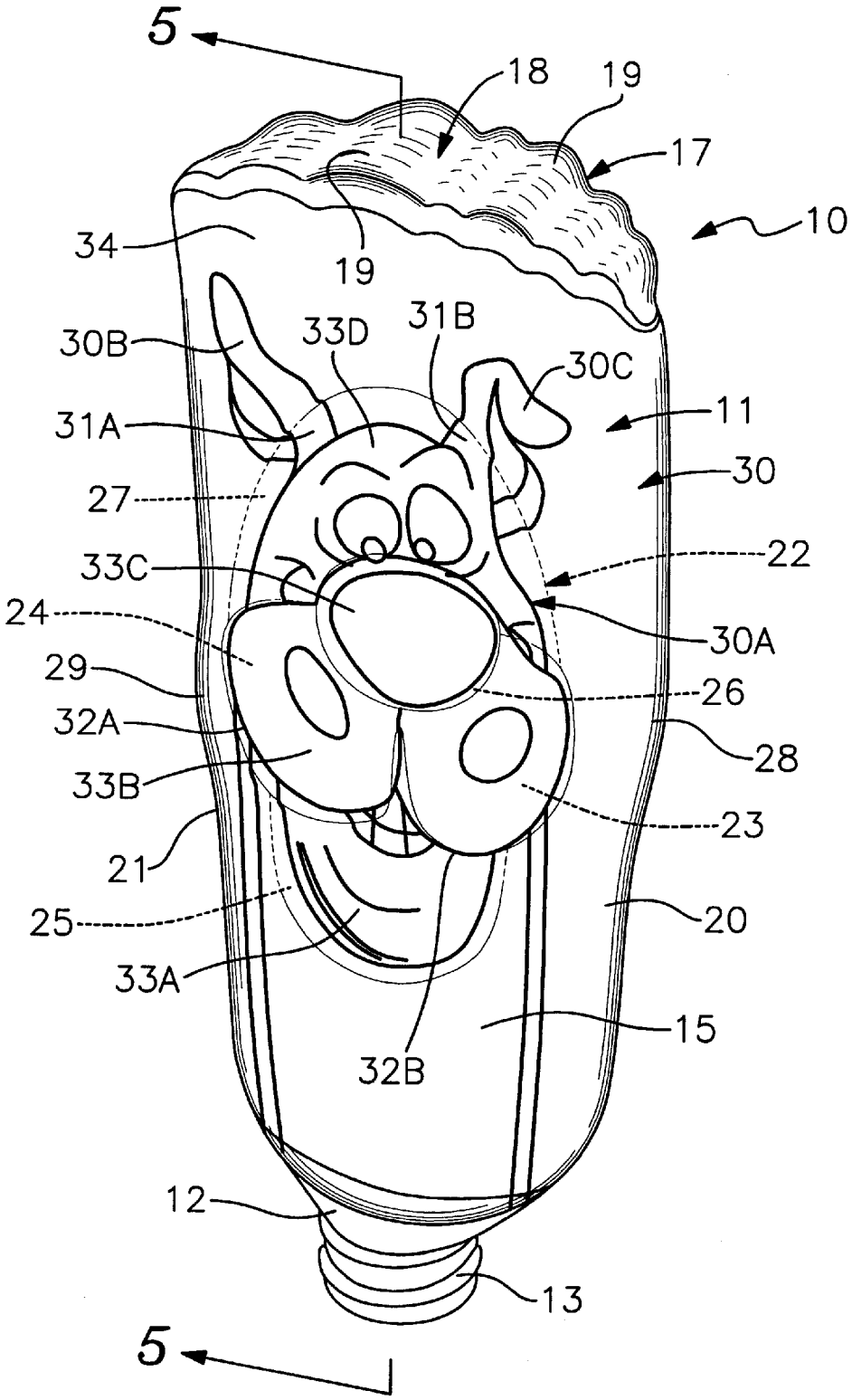
FIG. 1 is a perspective view of the completed dimensional container of the invention.
Figure 2:
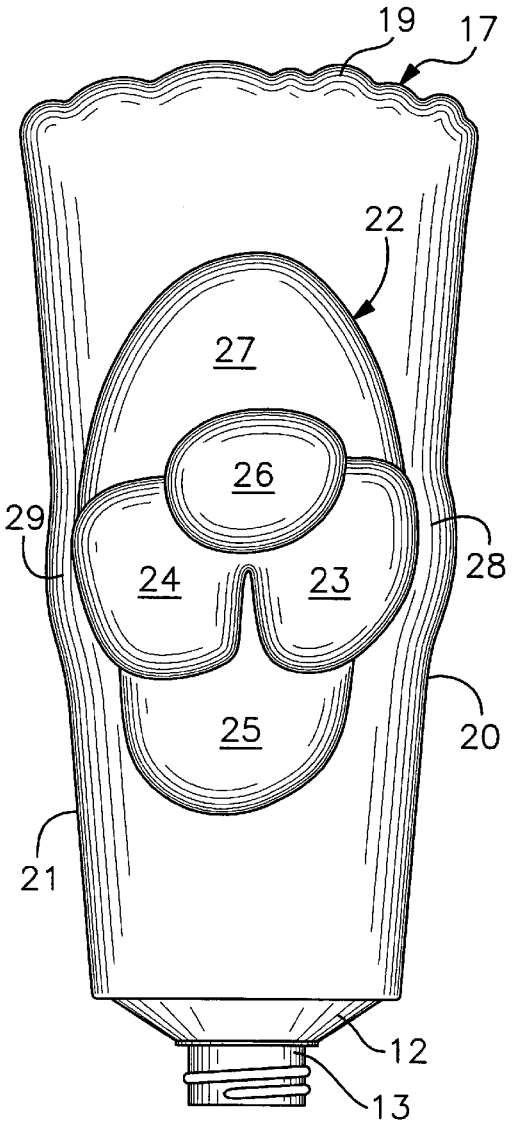
FIG. 2 is a front elevational view of the container only.
Figure 3:
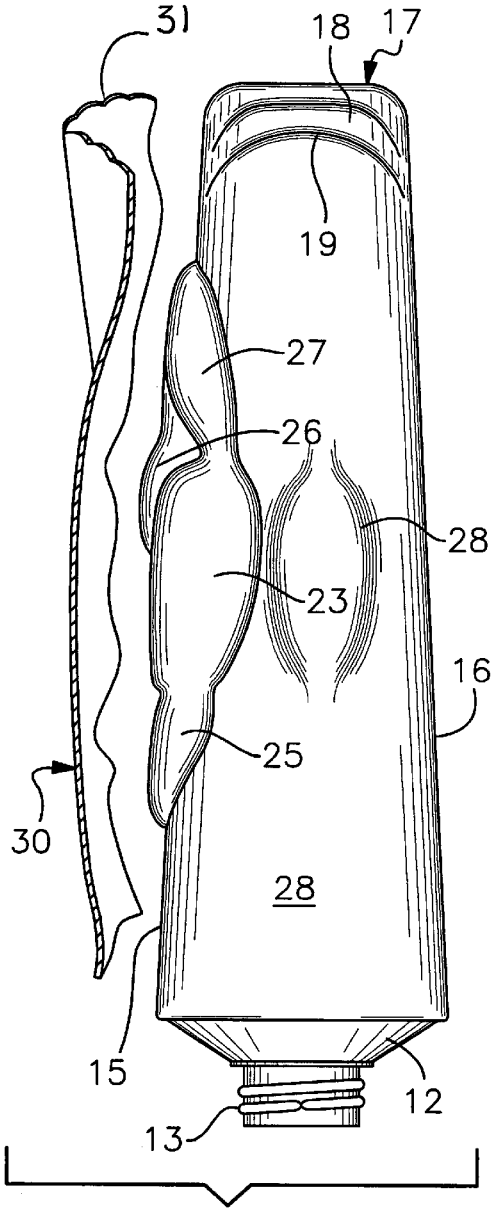
FIG. 3 is an exploded side-elevational view of the container and graphic overlay of the invention.

Referring now to FIGS. 1–3 of the drawings, a container 10 can be seen having a main body member 11 with an integral tapered neck portion 12 with a threaded spout extending therefrom. In this example chosen for illustration, the spout 13 is oriented at the "base" of the container on which a closure cap 14 is threadably engaged as illustrated in broken lines in FIG. 4 of the drawings. The container has a front display surface area 15 and a rear surface area 16 of the main body member 11. A top portion 17 is in oppositely disposed relation to the hereinbefore-described threaded spout 13. The top portion 17 has an undulating surface 18 defining multiple raised contoured areas 19 thereacross.

A pair of opposing sidewall portions 20 and 21 define an integral transitition between the respective front display surface 15 and the rear surface 16.

Referring now to FIGS. 2 and 3 of the drawings, it will be seen that the front display surface 15 has a raised contoured area 22 generally indicated by the broken lines in FIG. 1 of the drawings. The raised contoured area 22 is comprised of multiple interdependent portions of differing surface elevations at 23–27. Each of the surface elevation portions 23–27 define specific dimensional characteristics of the container front display surface 15. Secondary surface elevations 28 and 29 extend from the respective side portions 20 and 21 adjacent the raised contoured area 22.

A flat overlay sheet 30, best seen in FIGS. 3, 4, 6 and 7 of the drawings having two-dimensional indicia 30A printed thereon is formed into a cylindrical sleeve S for being registerably positioned over the from display surface 15 around the container as best seen in FIGS. 3, 4, 7 and 8 of the drawings. It should be noted that portions of the indicia 30A are visually distorted beyond that of the final viewable indicia illustrated by light lines in FIG. 6 of the drawings so that once applied to the raised surface elevations 22 they will impart a the three dimensionality to the container 10. The overlay sheet 30 has a contoured upper perimeter edge pattern 31 that is typically die cut from a printed rectangular stock bland 32 represented by broken lines in FIG. 6 of the drawings that is formed into the sleeve S as hereinbefore described. The contoured top edge 31 of the overlay sheet 30 is registerable generally with the hereinbefore-described undulated top surface elements 19 of the container 10.

Referring now to FIGS. 1–4 of the drawings, it will be seen that some areas of the indicia 30A on the overlay sheet 30 will register generally with the corresponding surface elevations 23–27. Perimeter edge portions 30B and 30C of the indicia 30A extend beyond the corresponding surface elevation 27 and define transitional areas indicated at 31A and 31B therebetween. Other perimeter edge portions 32A and 32B of the indicia 30A will register exactly with the corresponding transition edges of the surface elevations 24 and 23. Indicia representation areas 33A, 33B, 33C and 33D are positioned well within the corresponding surface elevations 23–27. It will be apparent from the above description that by combining different areas of visually distorted 30A and non-distorted indicia 33A to overlap, fall within and align with the respective surface elevations 23–27 that the three-dimensional aspect of both the raised elevation areas of the container's front display surface 15 and that of the imprinted overlay sheet 30 will be enhanced imparting a more life-like visualization to the container configuration of the invention.

Additionally, the secondary side surface elevations 28 and 29 of the representative sides 20 and 21 will impart additional 3-D characteristics to the container composite surface as is best seen in FIG. 2 of the drawings.

Figure 4:
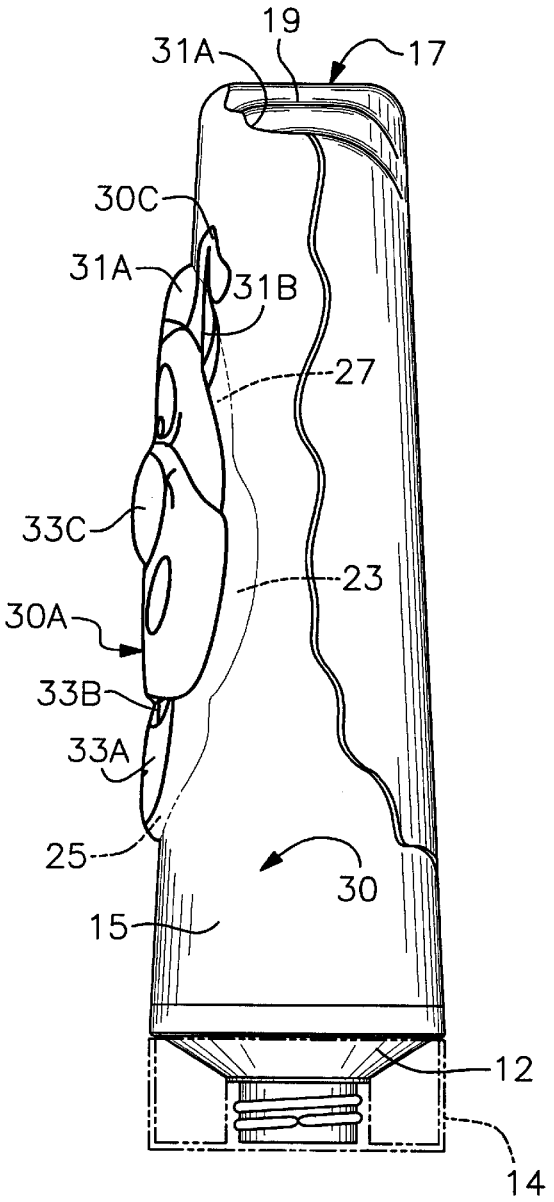
FIG. 4 is a side elevational view of a completed composite container with a two-dimensional overlay attached emphasizing selected features enhancement of the container.
Figure 5:
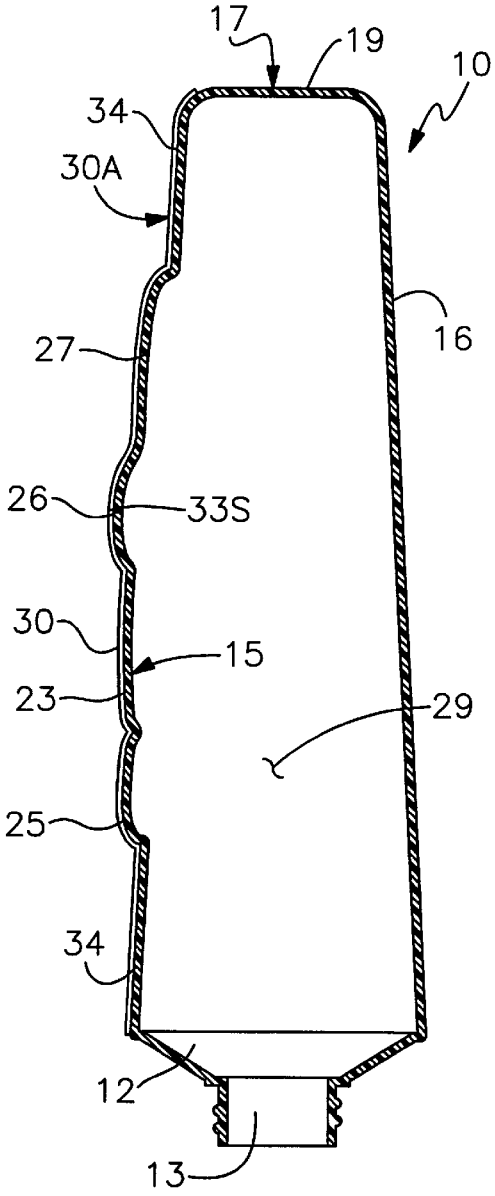
FIG. 5 is a cross-sectional view of the container on lines 5—5 of FIG. 1.
Figure 6:
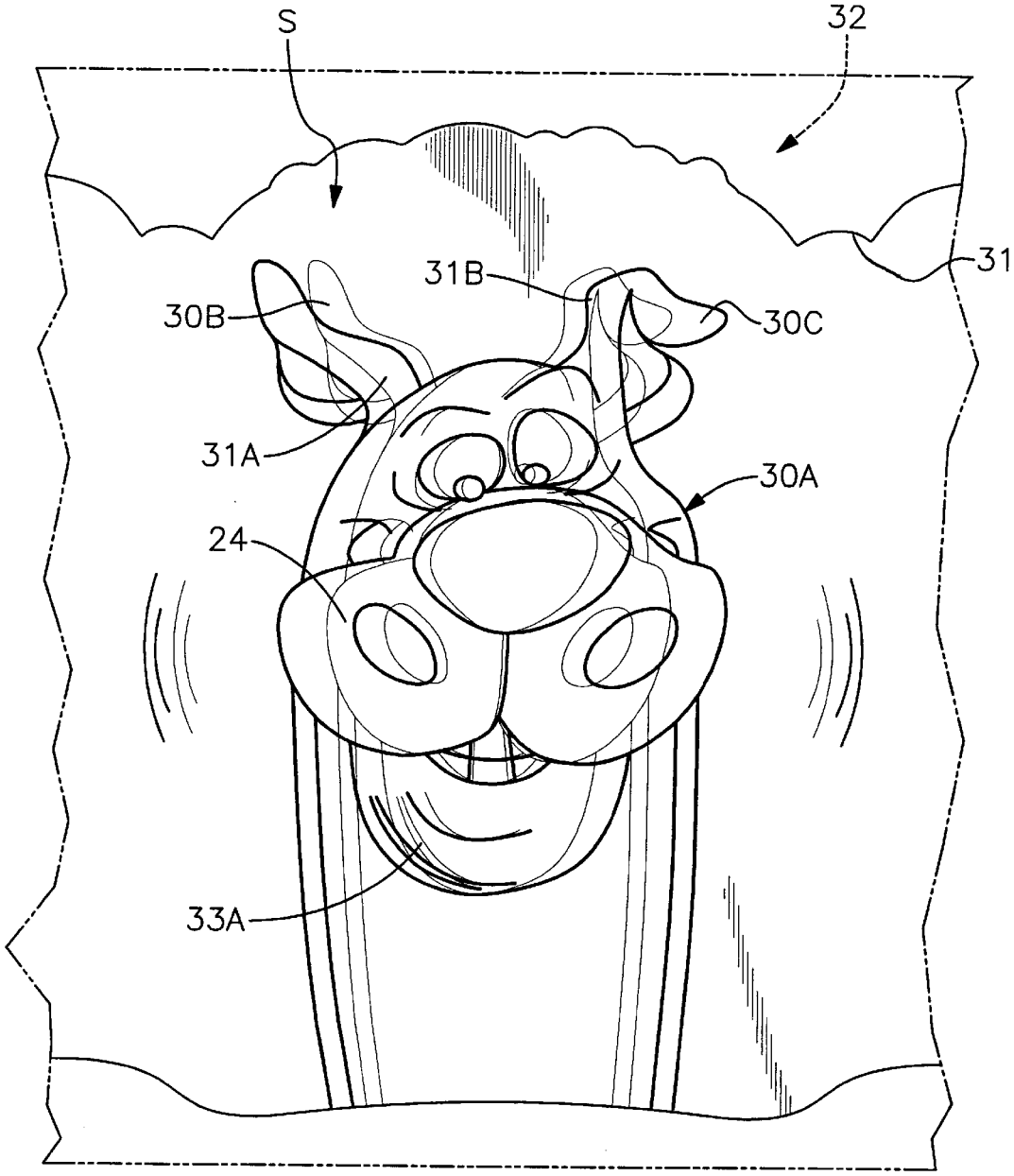
FIG. 6 is a front plan view of the two-dimensional overlay with indicia representations thereon.

Referring to FIGS. 1, 2 and 4 of the drawings, the transition areas 31A and 31 B can be seen wherein the indicia portion 30B and 30C extend over and beyond to a generally flat area 34 of the front display surface 15. It is this area that best illustrated the transitional enhanced nature of combining the distorted two-dimensional indicia 30A of the overlay sheet 30 on portions of a container that are both raised as in the surface area 27 and flat as at 34. This transitional continuation aspect is evident at each surface height transition and the corresponding overlying indicia representation 30A defining the enhanced three-dimensional aspects of the container 10.

Figure 7:
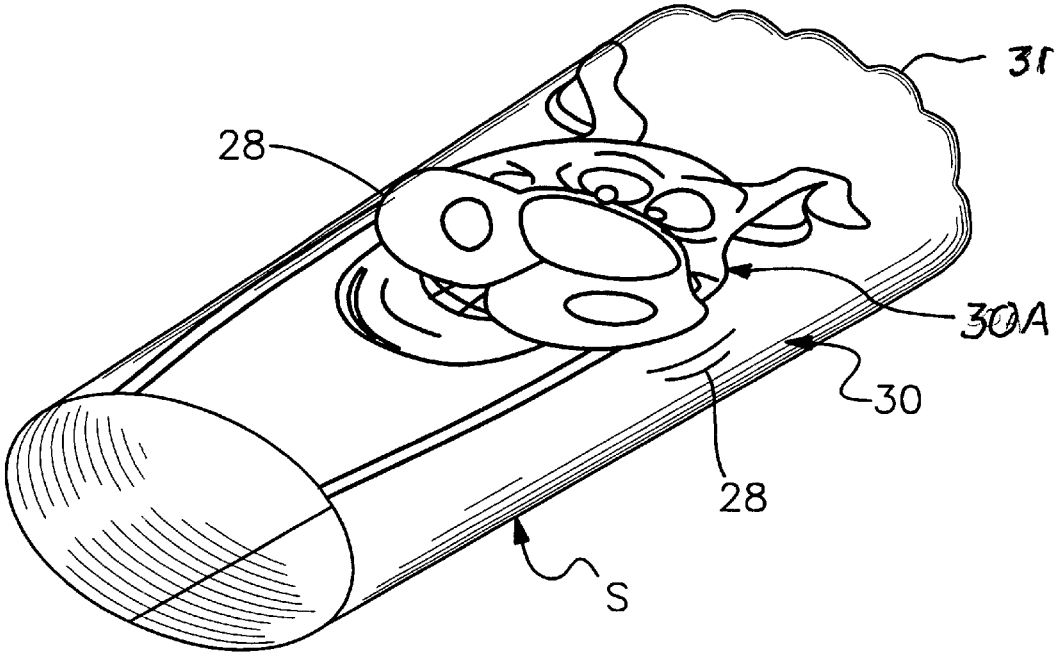
FIG. 7 is a perspective view of the graphic sleeve overlay.
Figure 8:
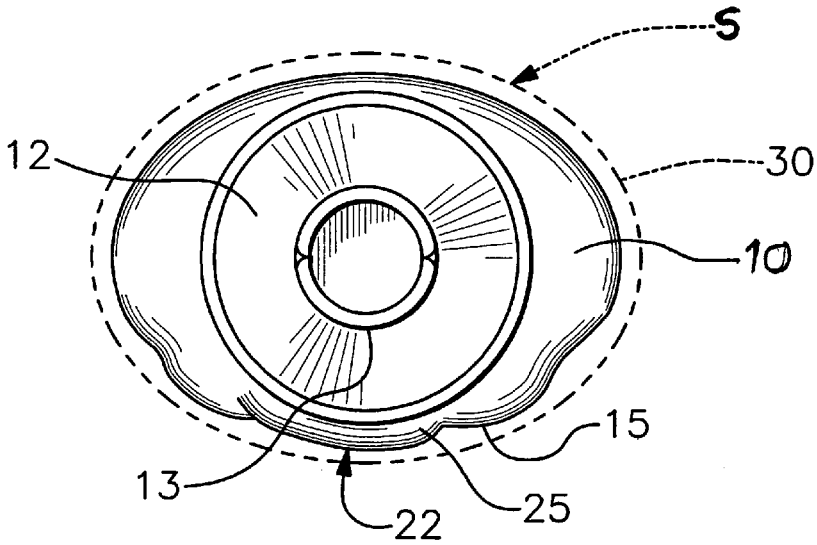
FIG. 8 is a top plan view of the container with the graphic sleeve overlay positioned thereon before being affixed to the container.

Referring now to FIGS. 7 and 8 of the drawings, the two-dimensional overlay sleeve S can be seen as to be applied over the container 10 and registerably bonded thereto as seen in thermal application process. Such thermal application process is well known in the art in which heat is applied to the sleeve S which is made of a synthetic resin material that is responsive to heat shrinking uniformly up to 25% of its original surface dimension. In FIG. 8 of the drawings, the sleeve S is illustrated by a broken line around the container 10 before the application of heat, as seen in the finished bottle configuration illustrated in FIG. 1.

It will thus be seen that a new and novel three-dimensional container configuration has been illustrated and described and it will be apparent to those skilled in the art that various changes and modifications may be made thereto without departing from the spirit of the invention.

Therefore we claim:

1. A multiple dimensional container configuration comprising; a container having a front display surface and oppositely disposed rear surface, integrally interconnecting side surfaces, a top surface, a bottom, and an opening in said container, a plurality of raised interconnected surface areas on said front display surface defining portions of a three dimensional character representation, a flexible overlay sleeve thermally secured to the container surface, said overlay sleeve having indicia thereon corresponding to the raised surface areas and visual three dimensional indicia extending beyond said raised surface areas, a plurality of transitional areas between said raised surface areas and said front display surface, visually distorted indicia on said overlay sleeve for applied registration with said raised and transition surface areas.

2. The multiple dimensional container configuration set forth in claim 1 wherein said indicia portions on said overlay sleeve corresponding to said respective raised surface areas are of a known dimension and said raised surface areas of a dimension less than that of said known overlay portions dimension.

3. The multiple dimensional container configuration set forth in claim 2 wherein said indicia portions are of an equal dimension to that of said known surface areas dimension.

4. The multiple dimensional container configuration set forth in claim 1 wherein said side surface areas of said container have raised surface areas.

5. The multiple dimensional container set forth in claim 4 wherein said raised surface areas of said side surfaces are adjacent said raised areas of said front display surface and having corresponding indicia thereon.

6. The multiple dimensional container configuration set forth in claim 1 wherein said overlay sleeve has contoured upper and lower perimeter edges registerable with corresponding portions of said container.

7. The multiple dimensional container configuration set forth in claim 1 wherein said container is formed of synthetic resin material.

8. A synthetic resin container having a front three dimensional display surface, an oppositely disposed rear surface with interconnecting side surfaces therebetween, a top surface and oppositely disposed bottom, an opening formed in said bottom, a pour spout around said opening, a plurality of interconnected elevated contoured areas on said front display surface, an overlay sleeve thermally secured to said container surfaces, indicia imprinted on said overlay sleeve defining portion of a corresponding three-dimensional image formed within the front display surfaces, portions of said indicia visually distorted registerable with portions of said elevated surface areas and extending therebeyond said elevated surface areas, a cap threadably disposed on said pour spout defining a contoured support surface.

9. The dimensional container set forth in claim 8 wherein said plurality of interconnected elevated contoured areas define areas of a three dimensional representation.

10. The dimensional container set forth in claim 8 wherein said visually distorted two-dimensional indicia on said overlay sheet define and conform to and extend beyond said raised areas upon application thereto.

11. The dimensional container set forth in claim 8 wherein said top surface is contoured having a plurality of longitudinally spaced transversely extending raised areas thereon.

12. The dimensional container set forth in claim 8 wherein said overlay sleeve has indicia extending beyond said elevated surface areas of said front display surface defines a plurality of transitional areas denoted by distorted indicia representations on said overlay sleeve.

* * * * *